US008505575B2

(12) United States Patent
Chen et al.

(10) Patent No.: US 8,505,575 B2
(45) Date of Patent: Aug. 13, 2013

(54) WATER SUPPLY MODULE FOR HYDROTHERAPY DEVICE

(75) Inventors: Shih-Chang Chen, Hsinchu County (TW); Tsair-Rong Chen, Hsinchu County (TW); Shih-Chieh Tsai, Changhua County (TW); Chun-Lung Chiu, Hsinchu County (TW); Chih-Hsiang Chen, Hsinchu County (TW)

(73) Assignee: Cashido Corporation, Hsinchu County (TW)

( * ) Notice: Subject to any disclaimer, the term of this patent is extended or adjusted under 35 U.S.C. 154(b) by 389 days.

(21) Appl. No.: 12/900,675

(22) Filed: Oct. 8, 2010

(65) Prior Publication Data

US 2012/0085442 A1 Apr. 12, 2012

(51) Int. Cl.
*A47K 3/10* (2006.01)

(52) U.S. Cl.
USPC ..... 137/565.17; 4/541.1; 4/541.5

(58) Field of Classification Search
USPC ..... 4/541.1, 541.3, 541.4, 509; 137/565.17, 137/565.36, 565.34
See application file for complete search history.

(56) References Cited

U.S. PATENT DOCUMENTS

| | | | | |
|---|---|---|---|---|
| 5,012,535 | A * | 5/1991 | Klotzbach | 4/541.2 |
| 6,405,387 | B1 * | 6/2002 | Barnes | 4/541.2 |
| 6,439,437 | B1 * | 8/2002 | Ollier et al. | 222/318 |
| 6,523,192 | B1 * | 2/2003 | Gloodt | 4/541.1 |
| 7,509,034 | B2 * | 3/2009 | Kadoma et al. | 392/386 |
| 2004/0034918 | A1 * | 2/2004 | Loyd et al. | 4/541.1 |

* cited by examiner

*Primary Examiner* — Craig Schneider
*Assistant Examiner* — Angelisa Hicks
(74) *Attorney, Agent, or Firm* — Rosenberg, Klein & Lee

(57) ABSTRACT

A water supply module for hydrotherapy, which includes a pump, a water inlet, a micro bubble water outlet, a pressurized water outlet, a relief valve, and a mixer. The water inlet is connected to the pump. The micro bubble water outlet and the pressurized water outlet are connected to an outlet of the pump. The relief valve is installed in between the outlet of the pump and the micro bubble water outlet, and the mixer is installed in between the water inlet and the relief valve. A drain valve is further connected off the bottom of the pump to drain out the residual water from the pump and the piping. The integrated water supply module provides space-saving advantage. Furthermore, by draining the residual water, the water supply module also improves SPA hygiene by reducing the risk of skin diseases and infections.

9 Claims, 3 Drawing Sheets

WATER SUPPLY MODULE FOR HYDROTHERAPY DEVICE

BACKGROUND OF THE INVENTION

1. Field of the Invention

The instant disclosure relates to a water supply module for hydrotherapy device: in particular, a compact water supply module for hydrotherapy device that is capable of effectively removing residual water from the pump and the piping.

2. Description of the Related Art

As society progresses, people are living under increasing stress. In severe cases, long term stresses can lead to serious illnesses. In response, recreation centers utilizing novel therapeutic devices become popular resorts that help people relieve stress. A popular example of such therapeutic device is the spa hydrotherapy machine, which generates pressurized streams of water to provide massage action for relieving stress.

For hydrotherapy, a micro bubble bathing system is also very important. During the formation of micro bubbles, fine water molecules and negative ions are generated with significant health benefits. In addition, micro bubbles provide visual and sensual relaxation to the spa users both physically and mentally.

However, conventional hydrotherapy machines often require complicated water piping, which occupy precious space and thus fail to meet today's demand for lightweight and compactness. Furthermore, current hydrotherapy units often leave residual water in the pump and the piping system, which poses health risks such as skin diseases or infections to the users.

Based on research and engineering practices, the inventor proposes a design solution to address the above issues.

SUMMARY OF THE INVENTION

To meet the demand for compactness, the object of the instant disclosure is to provide a space-saving water supply module for hydrotherapy.

The other objective of the instant disclosure is to provide a water supply module for hydrotherapy that removes residual water from the pump and the piping to improve spa hygiene.

To achieve the above objectives, the water supply module for hydrotherapy of the instant disclosure includes a pump having an outlet; a water inlet connected to the pump; a micro bubble water outlet connected to the outlet of the pump; a pressurized water outlet connected to the outlet of the pump; a relief valve set in between the outlet of the pump and the micro bubble water outlet; and a mixer in between the water inlet and the relief valve.

The instant disclosure provides another water supply module for hydrotherapy, which includes a pump having an outlet; a water inlet connected to the pump; a micro bubble water outlet connected to the outlet of the pump; a relief valve in between the outlet of the pump and the micro bubble water outlet; and a mixer in between the water inlet and the relief valve.

The instant disclosure has the following advantages. The water supply module for hydrotherapy of the instant disclosure integrates the pump, the water inlet, the micro bubble water outlet, the pressurized water outlet, the mixer, and the relief valve without complicated plumbing system. To meet the demand for compactness, the integration occupies less space in offering space-saving advantage.

For the instant disclosure, a drain valve can be further added to the bottom of the pump. A sensor can be installed inside the relief valve or the micro bubble water outlet. When the sensor detects no water inside the hydrotherapy unit, the drain valve is opened accordingly to drain the pump and the plumbing system. By draining out the residual water, the goal is to improve SPA hygiene by protecting the users from skin diseases and infections.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

The aforementioned illustrations and following detailed descriptions are exemplary for the purpose of further explaining the scope of the instant disclosure. Other objectives and advantages related to the instant disclosure will be illustrated in the subsequent descriptions and appended drawings.

Figure 1:
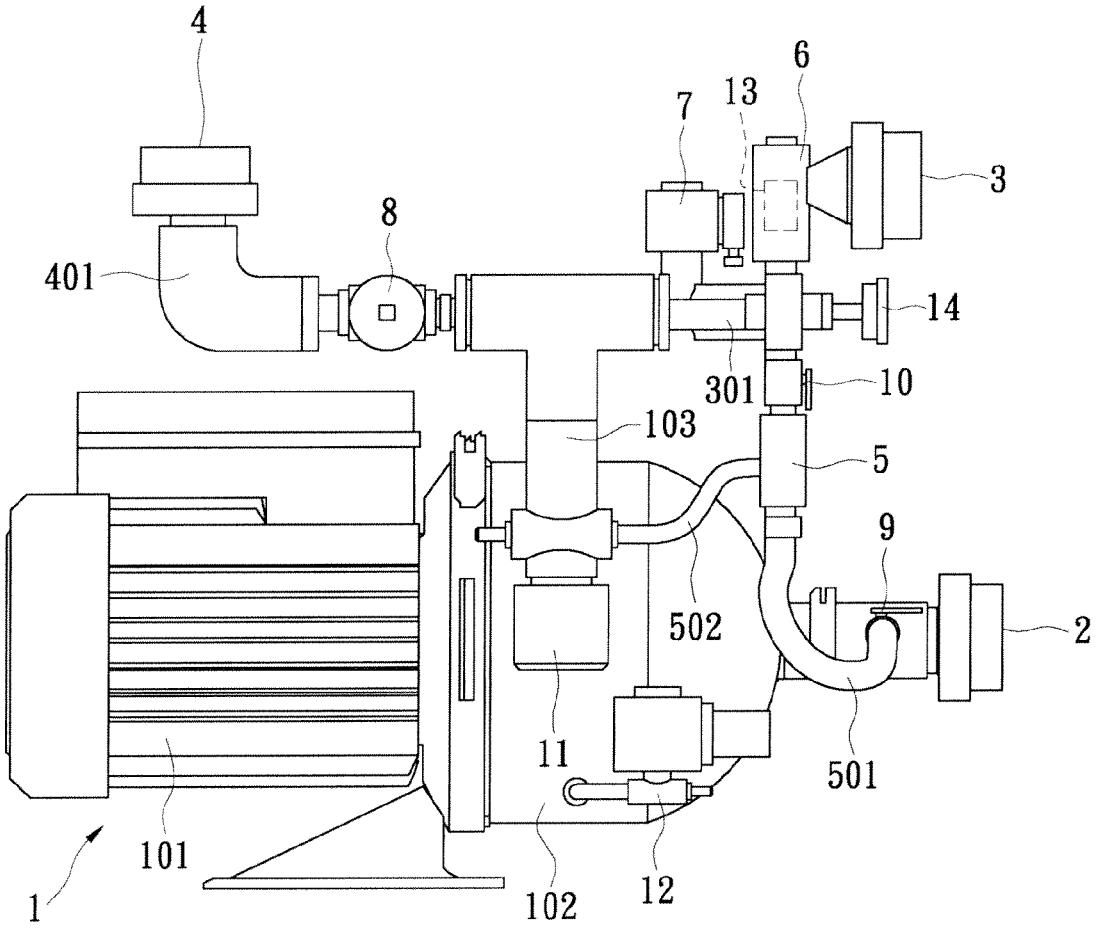
FIG. 1 shows a side view of a water supply module according to the instant disclosure.
Figure 2:
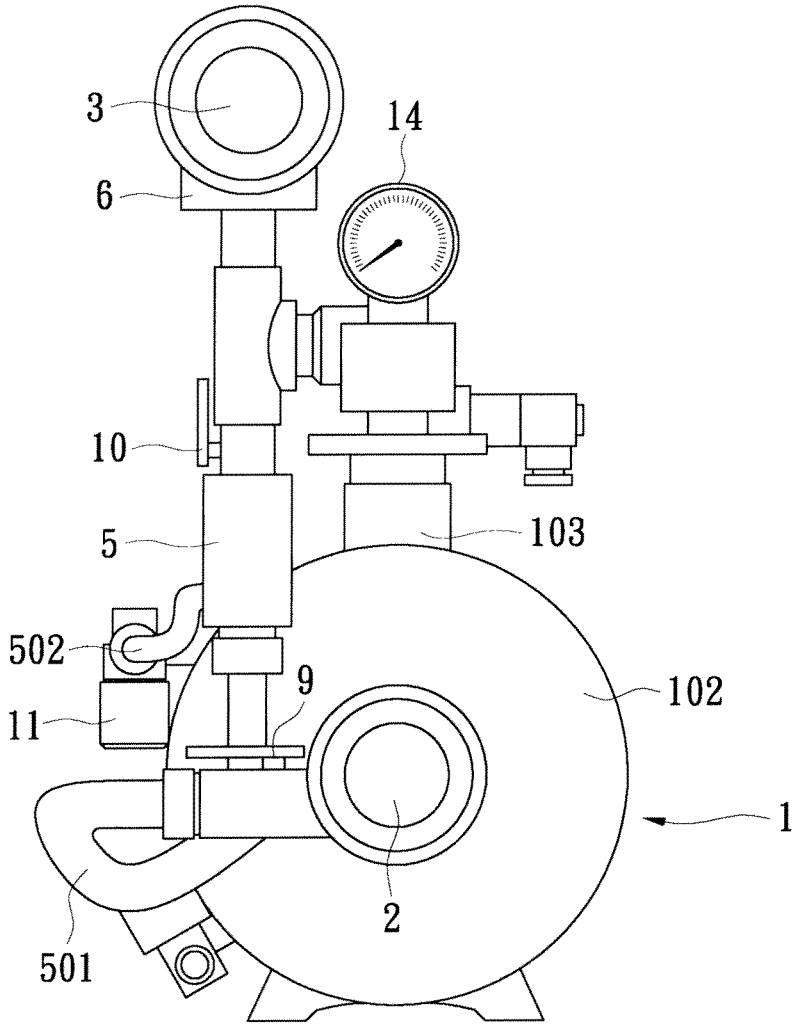
FIG. 2 shows a front view of a water supply module according to the instant disclosure.

Please refer to FIGS. 1 and 2. The instant disclosure provides a water supply module for hydrotherapy. The water supply module comprises a pump 1, a water inlet 2, a micro bubble water outlet 3, a pressurized water outlet 4, a mixer 5, and a relief valve 6. The pump 1 has a motor unit 101, that provides power to drive a pump unit 102. The pump 1 increases the water pressure and discharges the pressurized water through the outlet 103 of the pump unit 102.

Figure 3:
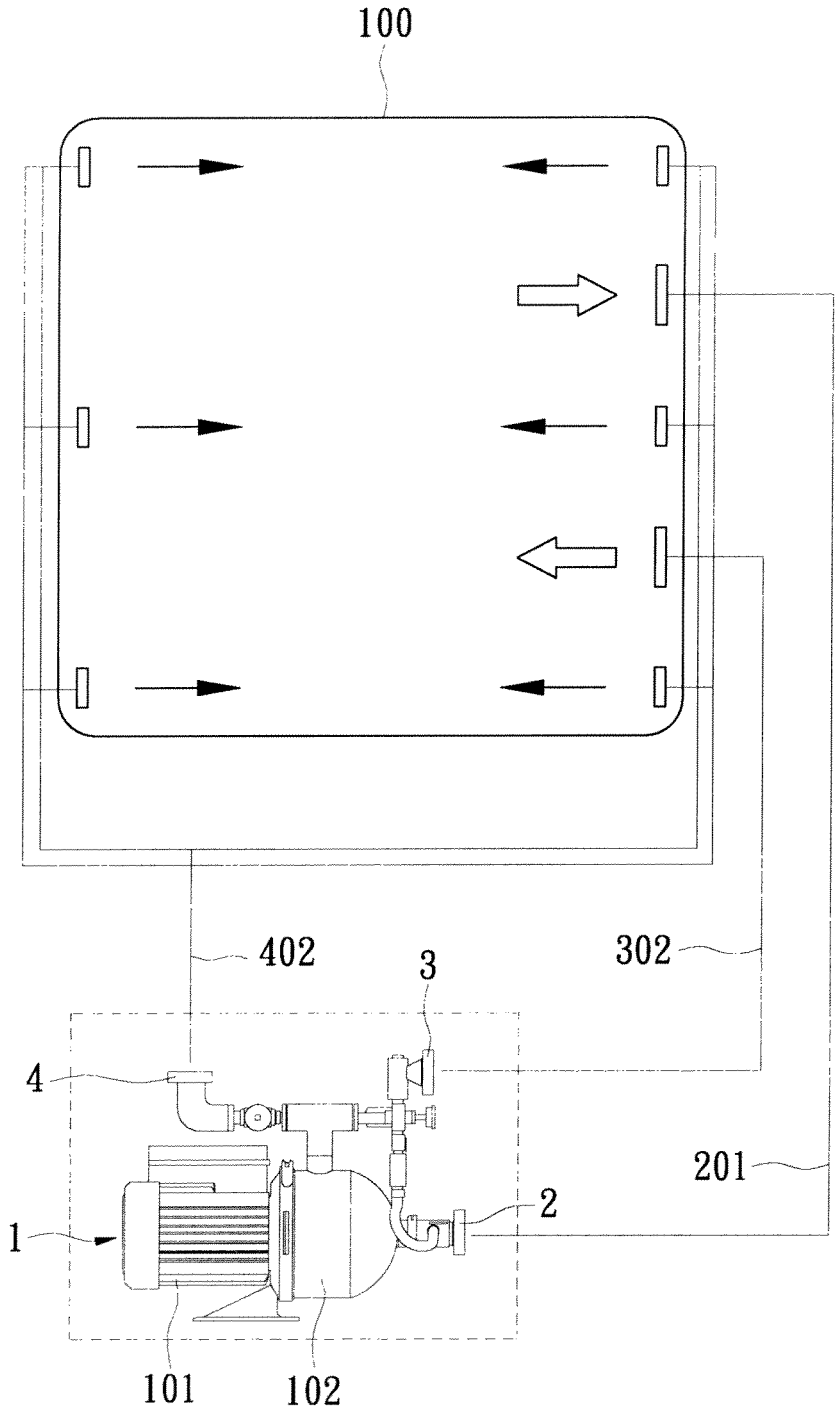
FIG. 3 shows a piping diagram of a water supply module for hydrotherapy according to the instant disclosure.

The water inlet 2 is connected to the pump unit 102 on one end, and the other end is connected to the water source by a suction line 201 (shown in FIG. 3). Via the water inlet 2, the pump unit 102 draws water from a hydrotherapy unit 100, such as a bathtub, into the water supply module.

The micro bubble water outlet 3 and the pressurized water outlet 4 are connected to the outlet 103 of the pump unit 102. The micro bubble water outlet 3 is connected to the outlet 103 of the pump unit 102 by a first discharge line 301. A micro bubble cut-off valve 7 can be installed to the first discharge line 301. The micro bubble cut-off valve 7 is a solenoid valve used for controlling the flow at the micro bubble water outlet 3. The micro bubble water outlet 3 is connected to the hydrotherapy unit 100 by a micro bubble water discharge line 302 (shown in FIG. 3). The micro bubble water discharge line 302 discharges micro bubble water into the hydrotherapy unit 100. Furthermore, a pressure gauge 14 can be installed at the end of the first discharge line 301 to indicate the line pressure.

The pressurized water outlet 4 is connected to the outlet 103 of the pump unit 102 by a second discharge line 401. A SPA cut-off valve 8 can be installed to the second discharge line 401. The SPA cut-off valve 8 is a solenoid valve used to control the flow at the pressurized water outlet 4. The pressurized water outlet 4 is connected to the hydrotherapy unit 100 by a SPA discharge line 402 (shown in FIG. 3), where water jets spurt into the hydrotherapy unit 100 to provide massage action.

For mixing air and water, the mixer 5 is structured similar to a Venturi tube. The mixer 5 is placed in between the water inlet 2 and the relief valve 6. A first tubing 501 is used to pipe the mixer 5 to the water inlet 2 for transporting needed water into the mixer 5. A first regulating valve 9 is installed in between the water inlet 2 and the first tubing 501. The first regulating valve 9 is used to control the water flow from the water inlet 2 through the first tubing 501 and to the mixer 5. At the mixer 5 outlet, aerated water is discharged. On the outlet side, the mixer 5 is piped to the relief valve 6 with a second regulating valve 10 installed in between. A second tubing 502 connects off the side of the mixer 5 to the control valve 11. For mixing air with water, the control valve 11 is a solenoid valve for controlling air intake into the mixer 5. The control valve 11 is used to open or close the supply of micro bubbles.

The relief valve 6 is placed in between the outlet 103 of the pump unit 102 and the micro-bubble water outlet 3. The relief valve 6 is connected to the outlet 103 of the pump unit 102 through the first discharge line 301. The relief valve 6 is also connected in between the second regulating valve 10 and the micro-bubble water outlet 3. Functionally, the relief valve 6 is used to control the pressure in the water supply module. From upstream, pressurized and aerated water enters the relief valve 6 from the pump unit 102 and the mixer 5. When passing through the relief valve 6, turbulence causes the aerated water to form super-fine water bubbles, or micro-bubbles.

A drain valve 12 is further connected to the bottom of the pump unit 102. The drain valve 12 is a solenoid valve for draining residual water from the pump unit 102 and the piping. The drain valve 12 is electrically connected to a sensor 13 inside the relief valve 6 or the micro-bubble water outlet 3. When the sensor 13 detects no water inside the hydrotherapy unit 100, such as a bathtub, the drain valve 12 is opened to drain out residual water from the pump unit 102 and the piping.

The water supply module for hydrotherapy of the instant disclosure integrates the pump unit 102, the water inlet 2, the micro-bubble water outlet 3, the pressurized water outlet 4, the mixer 5, and the relief valve 6 without complicated plumbing system. For light weight and compactness, the integration occupies less space in offering space-saving advantage.

Furthermore, the drain valve 12 is located off the bottom of the pump unit 102. The drain valve 12 is electrically connected to the sensor 13 inside the relief valve 6 or the micro-bubble water outlet 3. When the sensor 13 detects no water inside the hydrotherapy unit 100, such as a bathtub, the drain valve 12 is opened to drain out residual water from the pump unit 102 and the piping. By draining out residual water, SPA hygiene is improved by reducing the spread of skin diseases and infections.

In another embodiment of the instant disclosure, the pressurized water outlet 4 is excluded from the water supply module. The pump unit 102, the water inlet 2, the micro-bubble water outlet 3, the mixer 5, and the relief valve 6 are integrated in forming a water supply module, which provides solely micro-bubble water to the hydrotherapy unit 100.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A water supply module for a hydrotherapy device, comprising:

a pump having an outlet;

a water inlet connected to the pump;

a micro bubble water outlet connected to the outlet of the pump;

a pressurized water outlet connected to the outlet of the pump;

a relief valve connected in between the outlet of the pump and the micro bubble water outlet;

a mixer connected in between the water inlet and the relief valve, a first tubing (501) connecting the water inlet (2) and the mixer (5);

a first regulating valve (9) arranged between the first tubing (105) and the water inlet (2);

a second regulating valve (10) arranged between the mixer (5) and the relief valve (6);

and a second tubing (502) connecting the mixer to a control valve (11).

2. The water supply module for hydrotherapy of claim 1, wherein the bottom of the pump is connected to a drain valve; wherein the drain valve is electrically connected to a sensor device.

3. The water supply module for hydrotherapy of claim 1, wherein the relief valve is connected in between the second regulating valve and the micro bubble water outlet.

4. The water supply module for hydrotherapy of claim 1, wherein the pump is connected to a motor having a motor housing.

5. The water supply module for hydrotherapy of claim 4, wherein the micro bubble water outlet is connected to the outlet of the pump by a first discharge line;

wherein the first discharge line has a micro bubble cut-off valve and is connected to a pressure gauge.

6. The water supply module for hydrotherapy of claim 4, wherein the pressurized water outlet is connected to the outlet of the pump by a second discharge line;

wherein the second discharge line has a SPA cut-off valve.

7. The water supply module for hydrotherapy of claim 1, wherein the water inlet is connected to a water source by a water supply line, the micro bubble water outlet is connected to a hydrotherapy unit by a micro bubble water discharge line, and the pressurized water outlet is connected to the hydrotherapy unit by a SPA discharge line.

8. A water supply module for hydrotherapy, comprising:

a pump having an outlet;

a water inlet connected to the pump;

a micro bubble water outlet connected to the outlet of the pump;

a relief valve connected in between the outlet of the pump and the micro bubble water outlet; and a mixer connected in between the water inlet and the relief valve;

a first tubing connecting the water inlet and the mixer;

a first regulating valve arranged between the first tubing and the water inlet;

a second regulating valve arranged between the mixer and the relief valve; and a second tubing (502) connecting the mixer to a control valve (11).

9. The water supply module for hydrotherapy of claim 8, wherein the bottom of the pump is connected to a drain valve, wherein the drain valve is electrically connected to a sensor device.

* * * * *